US008534318B2

(12) United States Patent
Kanemaru et al.

(10) Patent No.: US 8,534,318 B2
(45) Date of Patent: Sep. 17, 2013

(54) WATER FAUCET DEVICE

(75) Inventors: Hiroshi Kanemaru, Fukuoka (JP); Kenichi Aoyagi, Fukuoka (JP); Masato Yamahigashi, Fukuoka (JP); Masateru Miyazaki, Fukuoka (JP); Tsuyoshi Miura, Fukuoka (JP)

(73) Assignee: Toto Ltd. (JP)

( * ) Notice: Subject to any disclaimer, the term of this patent is extended or adjusted under 35 U.S.C. 154(b) by 158 days.

(21) Appl. No.: 12/886,086

(22) Filed: Sep. 20, 2010

(65) Prior Publication Data

US 2011/0005627 A1 Jan. 13, 2011

Related U.S. Application Data

(63) Continuation of application No. PCT/JP2009/056102, filed on Mar. 26, 2009.

(30) Foreign Application Priority Data

Mar. 26, 2008 (JP) ..... 2008-081334

(51) Int. Cl.

| | |
|---|---|
| ***G05D 23/19*** | (2006.01) |
| ***G05D 7/06*** | (2006.01) |
| ***H01H 9/00*** | (2006.01) |
| ***F16K 11/18*** | (2006.01) |

(52) U.S. Cl.
USPC ..... 137/607; 137/636.4; 137/637.4; 137/898; 200/4; 236/12.12; 236/46 C

(58) Field of Classification Search
USPC ..... 137/636.4, 637.4, 898, 607, 597; 200/4; 236/12.1, 12.11, 12.12, 46 C
See application file for complete search history.

(56) References Cited

U.S. PATENT DOCUMENTS

| | | | | |
|---|---|---|---|---|
| 5,526,845 | A * | 6/1996 | Manos | 137/625.17 |
| 6,003,367 | A * | 12/1999 | Bux et al. | 73/462 |
| 6,621,016 | B2 | 9/2003 | Ohba et al. | |
| 7,361,854 | B2 * | 4/2008 | Basche et al. | 200/18 |
| 2002/0166754 | A1 | 11/2002 | Ohba et al. | |
| 2006/0130908 | A1 * | 6/2006 | Marty et al. | 137/613 |

FOREIGN PATENT DOCUMENTS

| | | |
|---|---|---|
| JP | 05-331888 | 12/1993 |
| JP | 2001-208229 A | 8/2001 |
| JP | 2002-343192 A | 11/2002 |
| JP | 2004-346710 A | 12/2004 |
| JP | 2006-120576 A | 5/2006 |

OTHER PUBLICATIONS

Written Opinion of the International Searching Authority; PCT/JP2009/056102; Jun. 2, 2009.
International Search Report; PCT/JP2009/056102; Jun. 2, 2009.

* cited by examiner

*Primary Examiner* — John K Fristoe, Jr.
*Assistant Examiner* — Atif Chaudry
(74) *Attorney, Agent, or Firm* — Studebaker & Brackett PC

(57) ABSTRACT

To provide a water spouting device capable of switching between spouting and stopping, flow volume adjustment, and spouted water temperature adjustment with a single operating portion. The present invention is a water faucet device (1) furnished with a flow volume adjustment function and a temperature adjustment function, including: an operating portion (6) capable of being pressed and rotated by a user; and flow volume/temperature adjustment means (10), whereby in a stopped water state, spouting is commenced when the operating portion of this flow volume/temperature adjustment means is pressed; in a spouting state, spouted water flow volume is changed when the operating portion is pressed continuously for a predetermined long-press determining time; and water flow is stopped when pressing of the operating portion ceases in less than the long-press determining time.

6 Claims, 13 Drawing Sheets

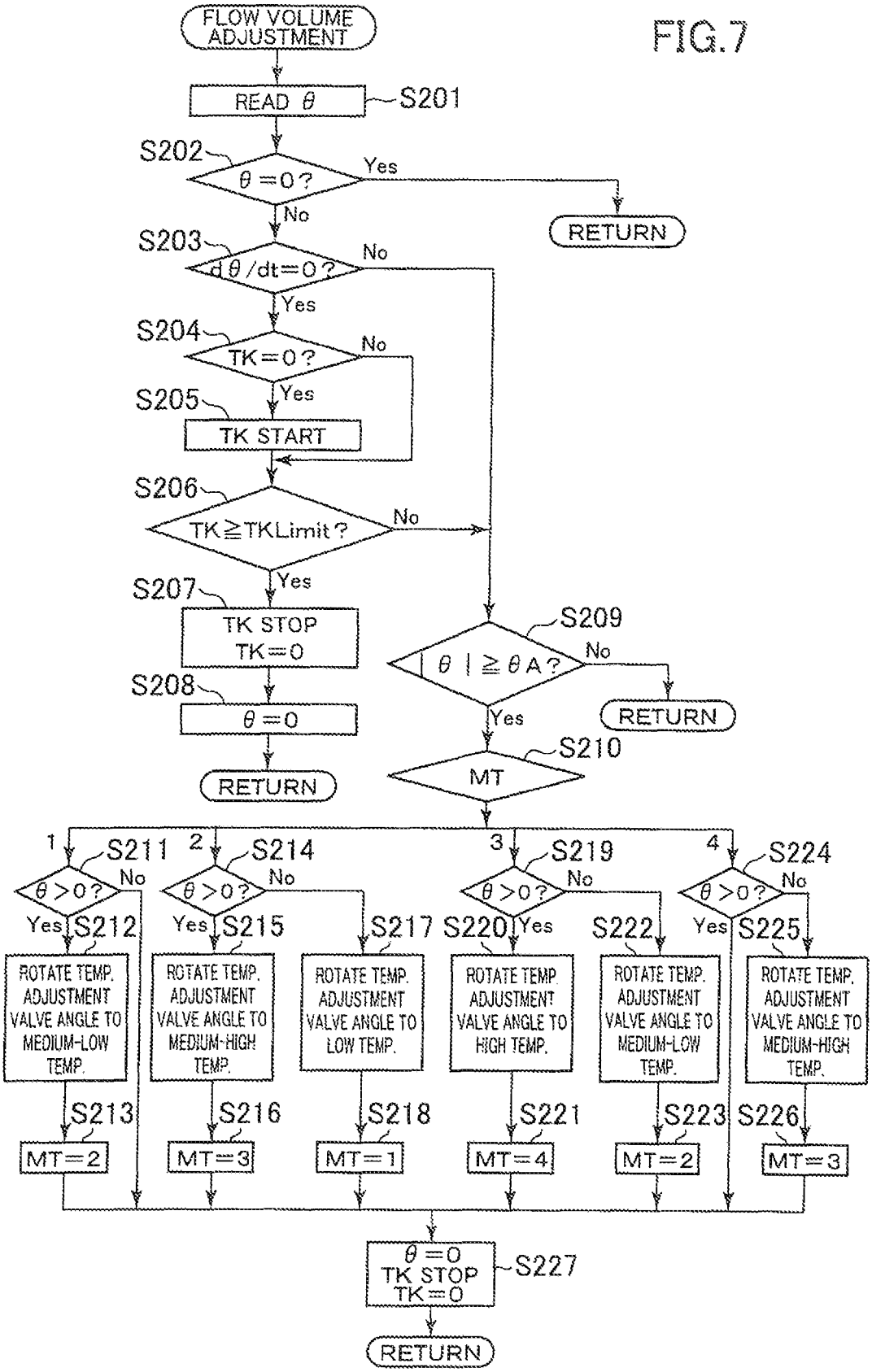
FIG.7
FLOW VOLUME ADJUSTMENT
READ θ
S201
S202
θ=0?
Yes
No
RETURN
S203
dθ/dt=0?
No
Yes
S204
TK=0?
No
Yes
S205
TK START
S206
TK≧TKLimit?
No
Yes
S207
TK STOP
TK=0
S208
θ=0
RETURN
S209
|θ|≧θA?
No
RETURN
Yes
S210
MT
1
2
3
4
S211
θ>0?
No
Yes
S212
ROTATE TEMP. ADJUSTMENT VALVE ANGLE TO MEDIUM-LOW TEMP.
S213
MT=2
S214
θ>0?
No
Yes
S215
ROTATE TEMP. ADJUSTMENT VALVE ANGLE TO MEDIUM-HIGH TEMP.
S216
MT=3
S217
ROTATE TEMP. ADJUSTMENT VALVE ANGLE TO LOW TEMP.
S218
MT=1
S219
θ>0?
No
Yes
S220
ROTATE TEMP ADJUSTMENT VALVE ANGLE TO HIGH TEMP.
S221
MT=4
S222
ROTATE TEMP. ADJUSTMENT VALVE ANGLE TO MEDIUM-LOW TEMP.
S223
MT=2
S224
θ>0?
No
Yes
S225
ROTATE TEMP. ADJUSTMENT VALVE ANGLE TO MEDIUM-HIGH TEMP.
S226
MT=3
θ=0
TK STOP
TK=0
S227
RETURN

WATER FAUCET DEVICE

TECHNICAL FIELD

The present invention relates to a water faucet device, and more particularly to a water faucet device furnished with a flow adjustment function and a temperature adjustment function

BACKGROUND ART

Laid Open Unexamined Patent Application H5-331888 (Patent Document 1) discloses a hot and cold water mixing device. This hot and cold water mixing device is furnished with a single lever-type controller constituted so that at least two systems of electrical signals can be adjusted by manipulating the inclination angle, direction, and the like of a single operating lever; spouted water flow volume and spouted water temperature can be adjusted by driving a flow control valve and a hot and cold water ratio control valve using electrical signals from this controller.

Laid Open Unexamined Patent Application 2001-208229 (Patent Document 2) discloses a water spout apparatus. In the water spout apparatus, a spout stopping portion is provided at the end portion of the apparatus, a temperature adjustment portion is provided at the base portion of the apparatus, and a flow adjustment portion is provided at the mid-portion thereof; spouting can thus be spouted, stopped, and variously adjusted.

Patent Document 1

Laid Open Unexamined Patent Application H5-331888.

Patent Document 2

Laid Open Unexamined Patent Application 2001-208229.

DISCLOSURE OF THE INVENTION

Problems the Invention Seeks to Resolve

In the hot and cold water mixing device disclosed in Laid Open Unexamined Patent Application H5-331888, is necessary when spouting is started to gradually raise the operating lever to increase the flow volume from a zero volume flow state to a desired flow volume, and when stopping, to gradually reduce the flow volume to zero. Therefore while it is true that the hot and cold water mixing device enables the adjustment of flow volume and temperature using a single operating lever to drive each control valve using electrical signals from a controller, there is no major difference in ease-of-use compared to a conventional "single lever faucet," and operability is not superior.

There is also a problem in that in the spout apparatus set forth in Laid Open Unexamined Patent Application 2001-208229, start/stop switchover and volume adjustment are independent, and while it is possible to easily obtain a desired flow volume, it is difficult to operate the apparatus quickly due to the separation of the operating portion into three locations. Also, because of the large number of operating portions, the problem arises that seals and other structural elements for maintaining the water tightness of each operating portion are complex, leading to increased costs.

The present invention therefore has the object of providing a water faucet device capable of switching between spouting and stopping, adjusting flow volume, and adjusting spout water temperature with a single operating portion.

Means for Solving the Problems

In order to resolve the aforementioned problems, the present invention is a water faucet device furnished with a flow volume adjustment function and a temperature adjustment function, comprising: an operating portion capable of being pressed and rotated by a user; and flow volume/temperature adjustment means, for switching between spouting and stopping water or changing spouting flow volume when the operating portion is pressed, and for changing the spouted water temperature when the operating portion is rotated; and whereby in a stopped water state, the flow volume/temperature adjustment means causes spouting to start when the operating portion is pressed; in a spouting state, the flow volume/temperature adjustment means causes to change spouted water flow volume when the operating portion is pressed continuously for a predetermined long-press determining time; and causes to stop spouting when pressing of the operating portion ceases in less than the long-press determining time.

In the present invention thus constituted, the flow volume/temperature adjustment means starts spouting when a user presses the operating portion in the stopped state. When a user presses down on the operating portion for a long period and continues to press for a predetermined time or greater in the spouting state, the flow volumes/temperature adjustment means changes the spout of water flow volume; if the pressing operation is long, but ends after less than a predetermined time, the flow volume and temperature adjustment means stops the flow of water.

In the present invention thus constituted, switching between spouting and stopping, flow volume adjustment, and spouted water temperature adjustment can be performed with a single operating portion.

The present invention is a water faucet device furnished with a flow volume adjustment function and a temperature adjustment function, comprising: an operating portion capable of being pushed in and rotated by a user; and flow volume/temperature adjustment means for switching between spouting and stopping water or changing spouting flow volume when the operating portion is pushed in, and for changing the spouted water temperature when the operating portion is rotated; whereby in a stopped water state, the flow volume/temperature adjustment means causes to start spouting when the operating portion is pushed in, and in a spouting state, the flow volume/temperature adjustment means causes to change the spout water flow volume when the operating portion is pushed in by a predetermined flow adjustment starting stroke or greater; and causes to stop water flow when the operating portion push-in stroke is less than the flow adjustment starting stroke.

In the present invention thus constituted, the flow volume/temperature adjustment means starts spouting when a user pushes in the operating portion in the stopped state. Also, when a user presses the operating portion so that it is pushed in by a predetermined flow adjustment starting stroke or greater in the spouting state, the flow volume/temperature adjustment means changes the spouted water flow volume, and when the push-in stroke of the operating portion is less than the flow adjustment starting stroke, the flow volume/temperature adjustment means stops water flow.

In the present invention thus constituted, switching between spouting and stopping, flow volume adjustment, and spouted water temperature adjustment can be performed with a single operating portion.

Furthermore, the present invention is a water faucet device furnished with a flow volume adjustment function and a temperature adjustment function, comprising: an operating portion capable of being pressed and rotated by a user; and flow volume/temperature adjustment means, for switching between spouting and stopping water or changing spouting flow volume when the operating portion is pressed, and for changing the spouted water temperature when the operating portion is rotated; and whereby in a stopped water state, the flow volume/temperature adjustment means causes to start spouting when the operating portion is pressed and in a spouting state, the flow volume/temperature adjustment means causes to change the spout water flow volume when the operating portion is pressed by a predetermined flow adjustment starting pressing force or greater and causes to stop water flow when the force pressing on the operating portion is less than the flow adjustment starting pressing force.

In the present invention thus constituted, the flow volume/temperature adjustment means starts spouting when a user presses the operating portion in the stopped state. Also, when a user presses the operating portion with a force greater than a predetermined flow adjustment startup pressing force in the spouting state, the flow volume/temperature adjustment means changes the spouted water flow volume, and when the push-in force on the operating portion is less than the startup pressing force, the flow volume/temperature adjustment means allows water spouting.

In the present invention thus constituted, switching between spouting and stopping, flow volume adjustment, and spouted water temperature adjustment can be performed with a single operating portion.

In the present invention, the angle to which the operating portion can be rotated is unlimited, and the flow volume/temperature adjustment means changes the spouted water temperature in response to the rotational angle of the operating portion in a single rotary operation.

In the present invention thus constituted, the spouted water temperature is changed in response to the rotational angle of the operating portion in a single rotary operation, therefore the spouted water temperature is changed not by the absolute rotational position, but rather by the relative rotational position of the operating portion.

In the present invention thus constituted, the spouted water temperature can be changed using a relative rotational position, therefore temperature adjustment operation is improved.

In the present invention, the flow volume/temperature adjustment means preferably adjusts the spouted water temperature in a stepped manner in response to the rotary operation angle of the operating portion in a single rotary operation, and does not change the spouted water temperature when the rotary operation angle in a single rotary operation is less than a predetermined rotary operation determining angle.

In the present invention thus constituted, the spouted water temperature is not changed when the rotary operation angle in a single rotary operation is less than a predetermined rotary operation determining angle, therefore preventing accidental rotation of the operating portion during a pressing operation causing an unintentional change in the spouted water temperature.

In the present invention, the flow volume/temperature adjustment means is preferably furnished with memory means for storing a set flow volume and set temperature at the time spouting is stopped; when spouting is next started, the flow volume/temperature adjustment means starts spouting at the set flow volume and set temperature stored in the memory means.

In the present invention thus constituted, spouting is started at the set flow volume and set temperature previously set and stored in the memory means, therefore there is no requirement to re-set, and water faucet device operability can be improved.

In the present invention, the flow volume/temperature adjustment means is preferably furnished with time counting means for accumulating elapsed time following the previous end of spouting; when the elapsed time accumulated by this time counting means is equal to or greater than a predetermined timeout time, the flow volume/temperature adjustment means causes spouting to start at a predetermined default flow volume and default temperature, regardless of the set volume and set temperature stored in the memory means.

In the present invention thus constituted, spouting is started in the next spouting iteration at a predetermined default flow volume and default temperature when the elapsed time after spouting ended is equal to or greater than a predetermined timeout time.

In the present invention, the flow volume/temperature adjustment means is preferably constituted to change the flow volume in a multistage stepped fashion, and continuous pressing or pushing in on the operating portion causes a repeated stepped increase or decrease in the spouted water flow volume.

In the present invention thus constituted, stepped increases or decreases of the spouted water flow volume are repeated by continuously pressing or pushing in the operating portion, enabling the spouted water flow volume to be increased or decreased in a single operation.

Effect of the Invention

In the water spouting device of the present invention, switching between spouting and stopping, flow volume adjustment, and spouted water temperature adjustment can be performed using a single operating portion.

A perspective drawing showing the entirety of a water faucet device according to a first embodiment of the invention.

FIG. 2

A block diagram showing the faucet function portion of a water faucet device according to a first embodiment of the invention.

FIG. 3

A cross-section showing a water faucet device according to a first embodiment of the invention.

FIG. 4

A timing chart showing the operation of a water faucet according to a first embodiment of the invention.

FIG. 5

A control flowchart showing the operation of a water faucet according to a first embodiment of the invention.

FIG. 6

Figure 5:
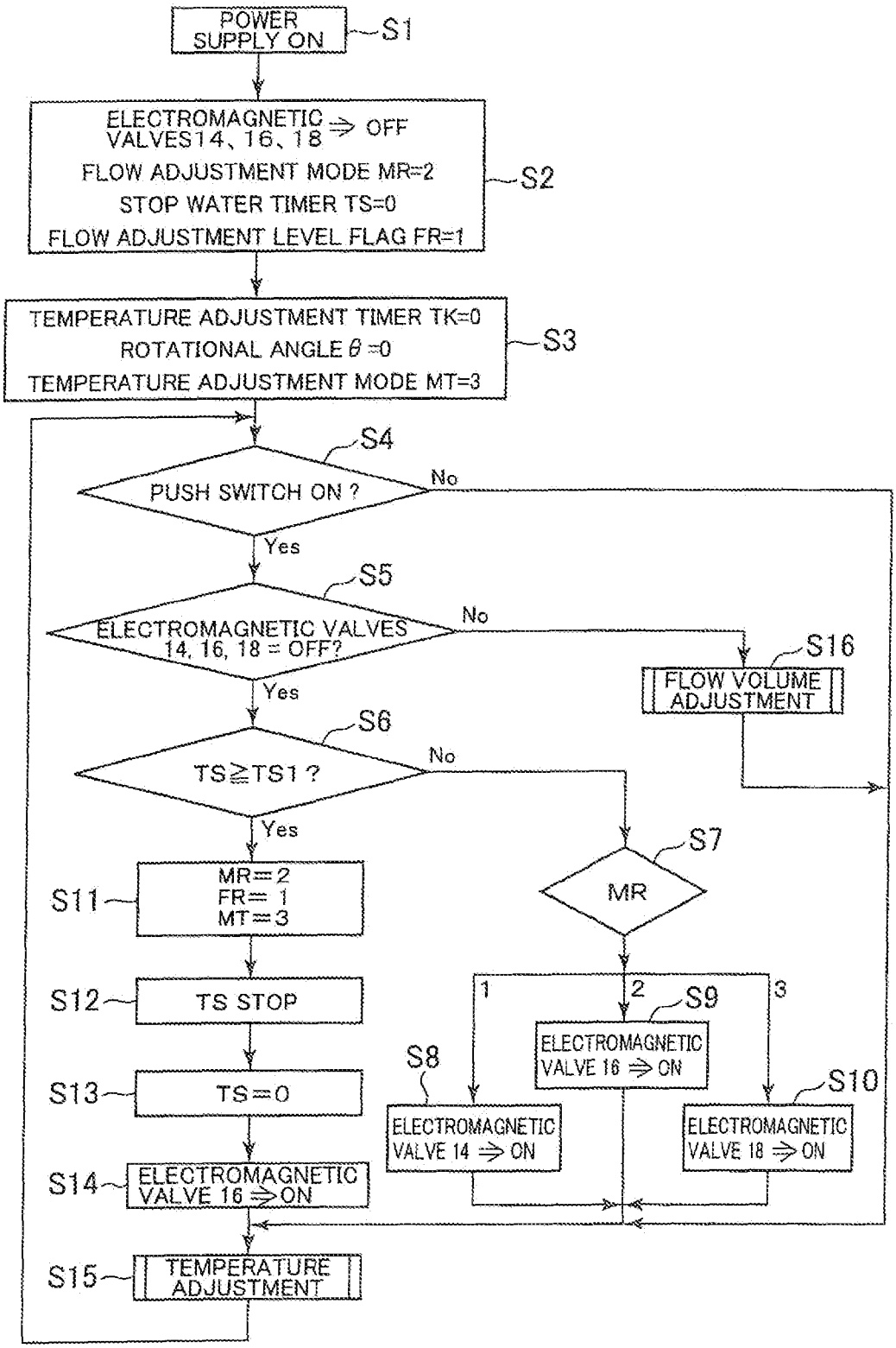

A flowchart of the subroutines called in the FIG. 5 flowchart, primarily showing flow adjustment processing.

FIG. 7

A flowchart of the subroutines called in the FIG. 5 flowchart, primarily showing temperature adjustment processing.

FIG. 8

A cross-section of an operating portion used in a water faucet device according to a second embodiment of the invention.

FIG. 9

A timing chart showing the operation of a water faucet according to a second embodiment of the invention.

FIG. 10

A control flowchart showing a water faucet according to a second embodiment of the invention.

FIG. 11

Figure 10:
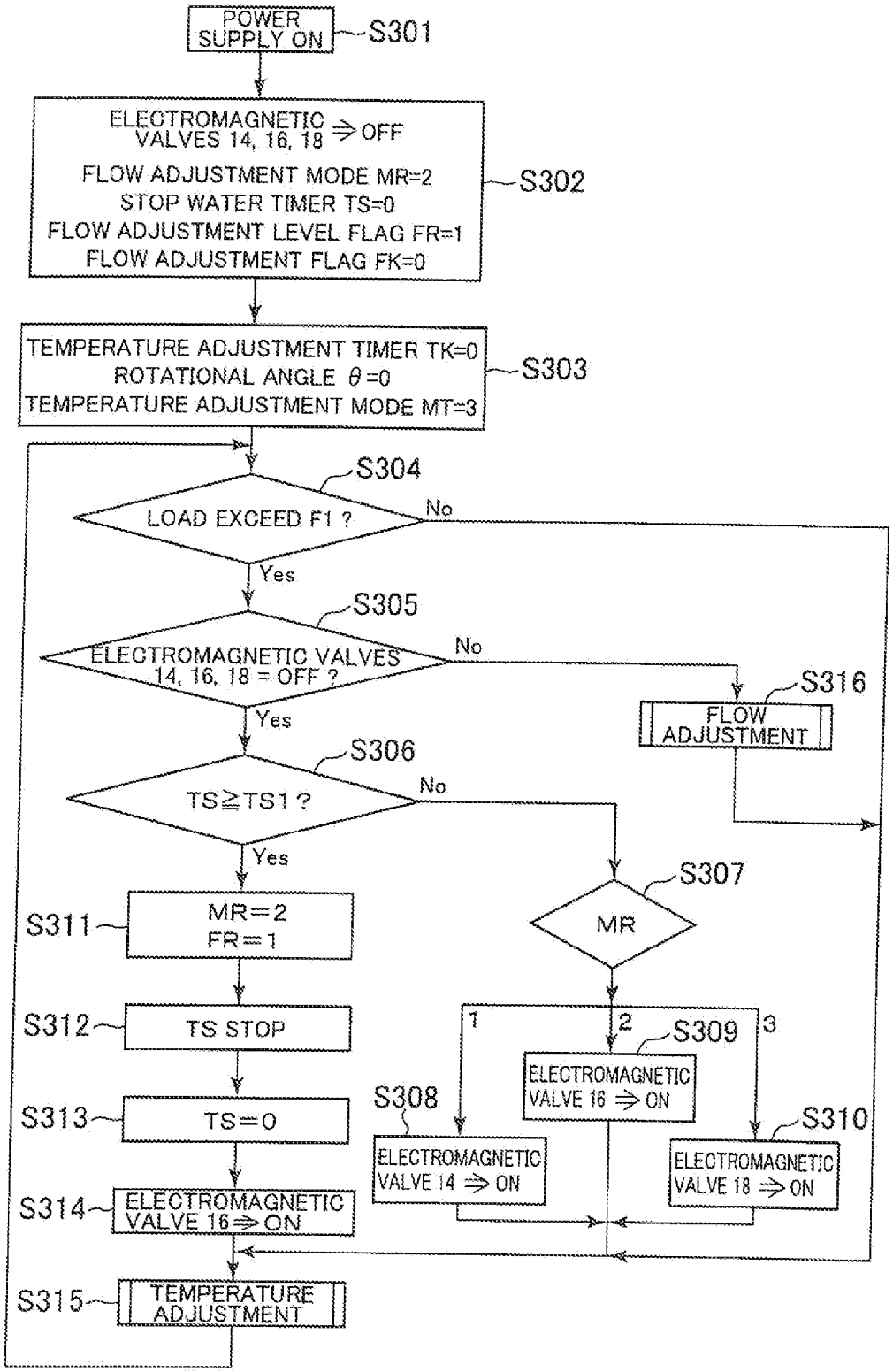

A flowchart of the subroutines called in the FIG. 10 flowchart.

FIG. 12

Figure 11:
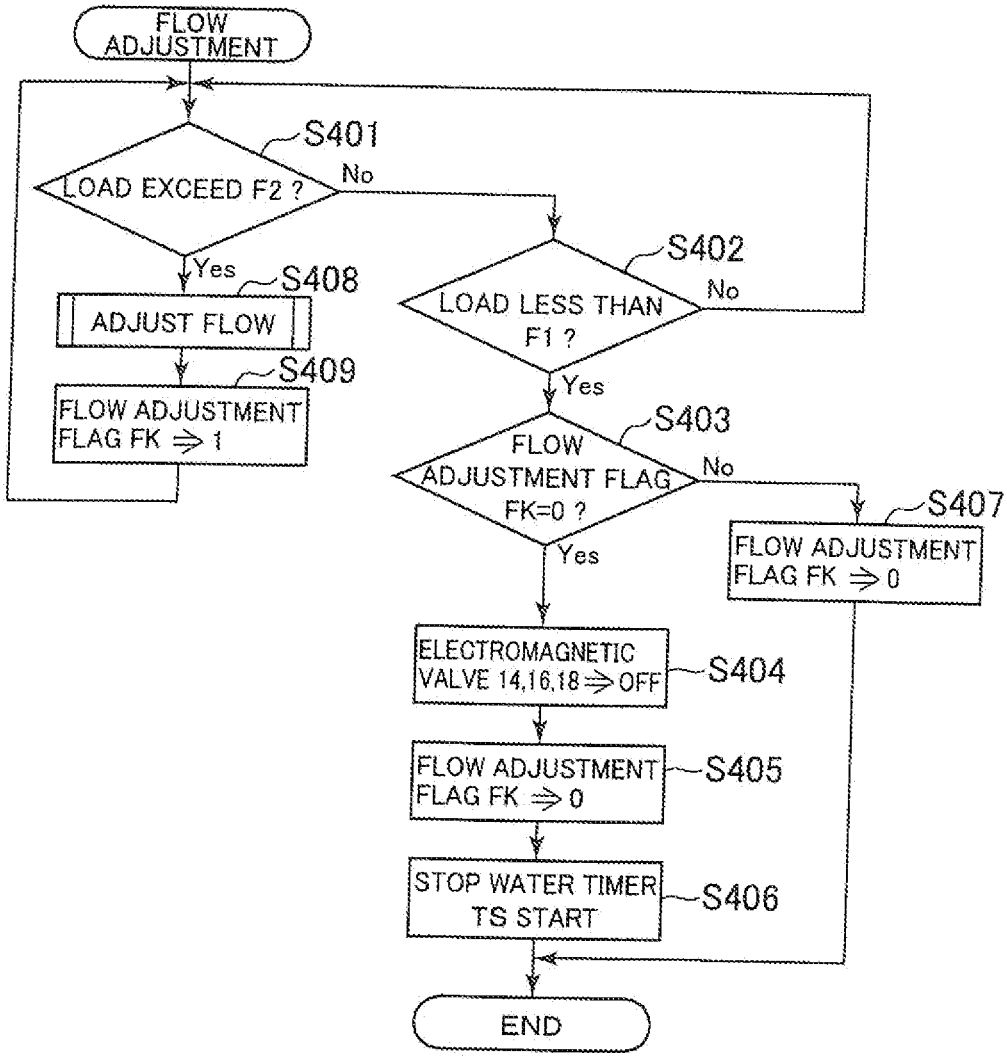

A flowchart of the subroutines called in the FIG. 11 flowchart.

FIG. 13

A cross-section of an operating portion used in a water faucet device according to a third embodiment of the invention.

BEST MODE FOR PRACTICING THE INVENTION

Next, referring to the attached drawings, we discuss embodiments of the invention.

Figure 1:
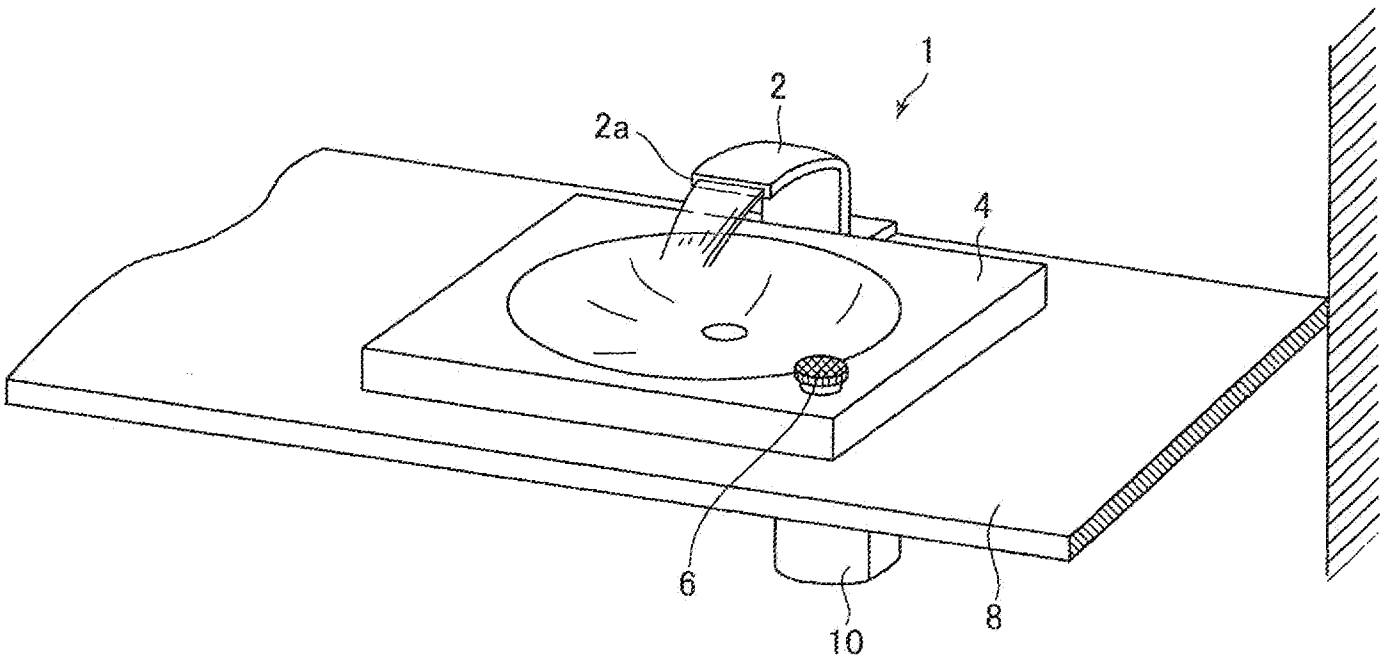
FIG. 1
Figure 2:
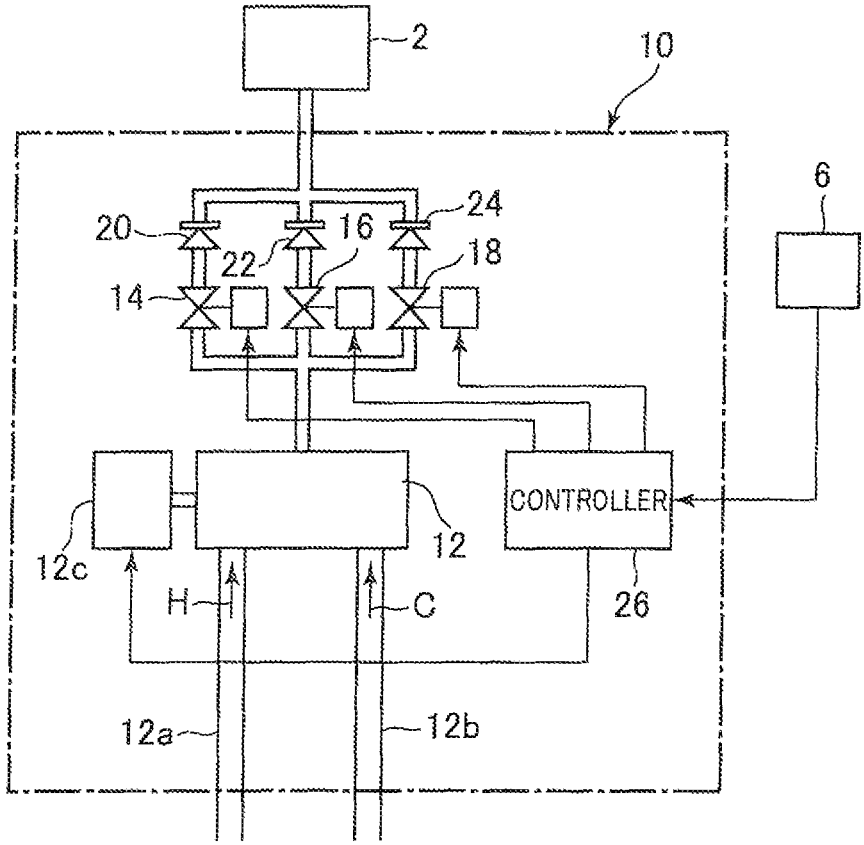
Figure 3:
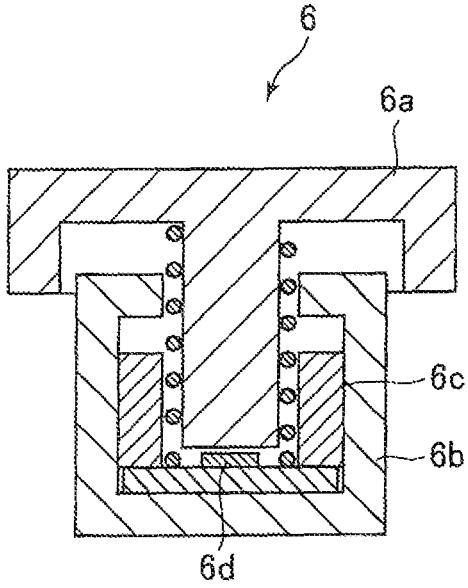
Figure 4:
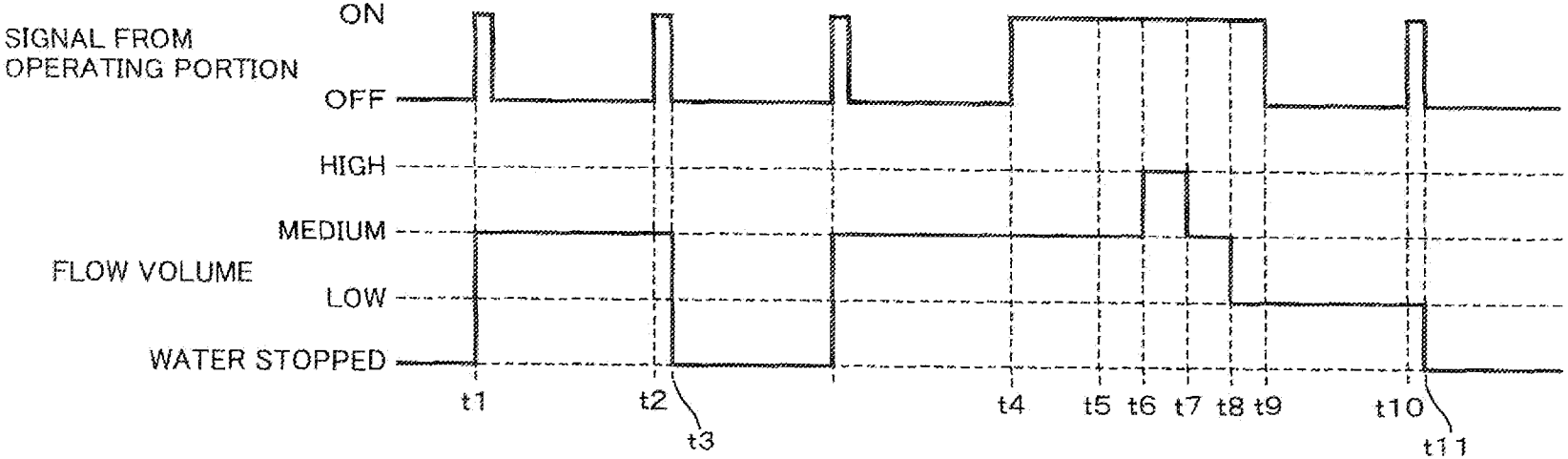
Figure 6:
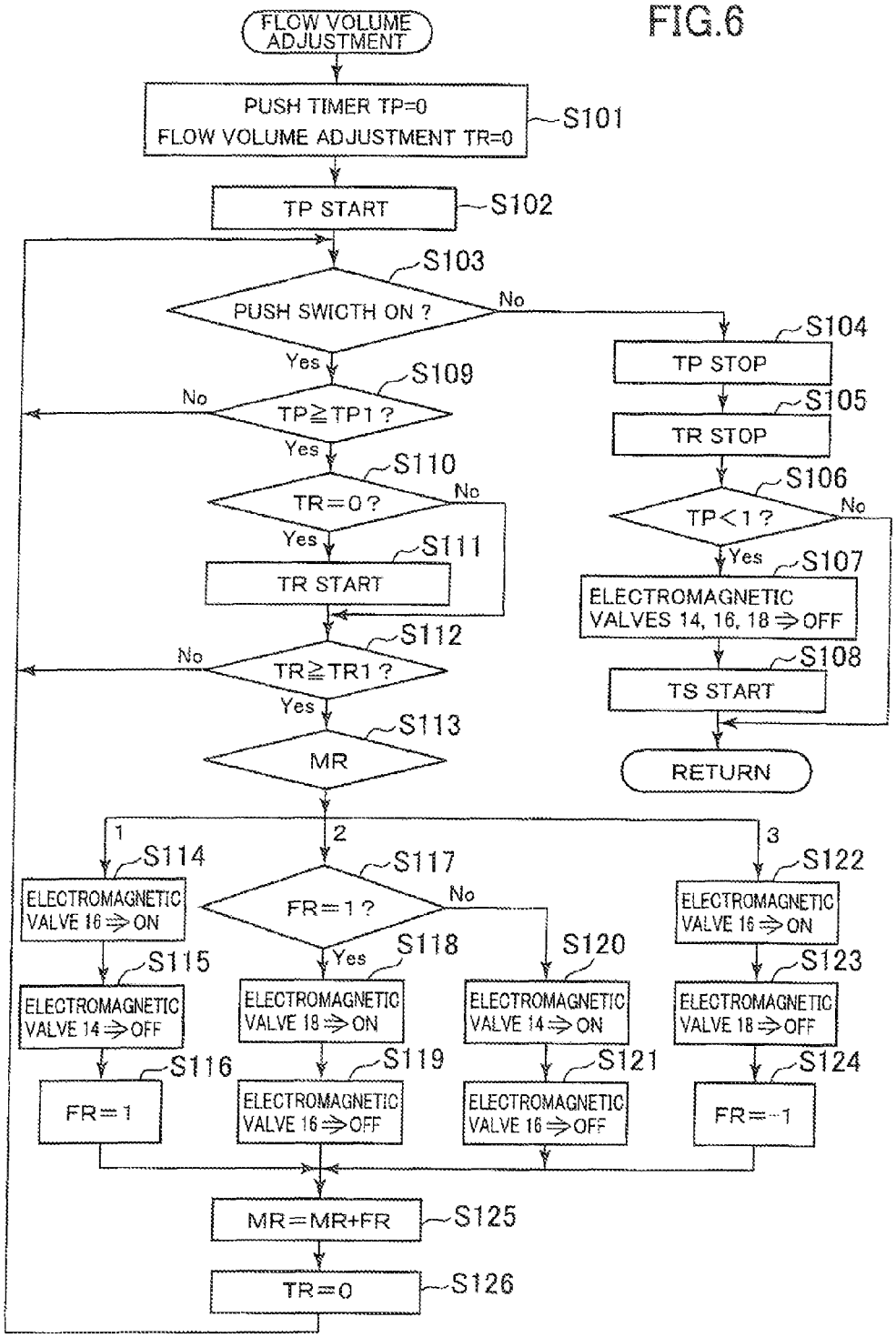

First, referring to FIGS. 1 through 7, we discuss the water faucet device of a first embodiment. FIG. 1 is a perspective drawing showing the entirety of a water faucet device according to the present embodiment. FIG. 2 is a block diagram showing the faucet function portion of a water faucet device according to the present embodiment. FIG. 3 is a cross-section of the operating portion of a water faucet device according to the present embodiment. Furthermore, FIG. 4 is a timing chart showing the operation of the water faucet device of the present embodiment, and FIGS. 5 through 7 are control flowcharts showing the operation of the water faucet device.

As shown in FIG. 1, the water faucet device 1 of the first embodiment of the present invention has a water faucet main unit 2 provided with a spouting port 2*a*; an operating portion 6; and a water faucet function portion 10 serving as a flow/temperature adjustment means, disposed underneath a sink counter 8, in which a wash bowl 4 is disposed.

In the water faucet device 1, operating the operating portion 6 causes electrical signals to be sent to the water faucet function portion 10, enabling various functions to be executed. That is, the water faucet device 1 is constituted so that switching between spouting and stopping water, and adjustment of the spouted water flow volume from the faucet main unit 2 spouting port 2*a*, can be accomplished by pressing the operating portion 6, and the spouted water temperature can be adjusted by rotating the operating portion 6. In other words, the water faucet device 1 of the present embodiment allows the accomplishment of switching between spouting and stopping water, and of the flow adjustment function and the temperature adjustment function, with a single operating portion 6.

As shown in FIG. 2, the water faucet function portion 10 has: a temperature adjustment valve 12 connected to a hot water supply pipe 12*a* and a cold water supply pipe 12*b*; three electromagnetic valves 14, 16, and 18; three fixed flow valves 20, 22, and 24 respectively connected between the electromagnetic valves and the water faucet main unit 2; and a controller 26 for controlling the temperature control valve 12 and each of the electromagnetic valves.

Connected in parallel to the outlet path of the temperature control valve 12 are three electromagnetic valves: a low-flow electromagnetic valve 14, a medium-flow electromagnetic valve 16, and a large flow electromagnetic valve 18. In addition, fixed flow valves are respectively connected in series on the outlet side of each of the electromagnetic valves. In other words, a low-flow fixed flow valve 20 is connected on the outlet side of the low-flow electromagnetic valve 14; a medium-flow fixed flow valve 22 is connected on the outlet side of the medium-flow electromagnetic valve 16; and a large flow fixed flow valve 24 is connected on the outlet side of the large flow electromagnetic valve 18. Furthermore, the outlet sides of each of the fixed flow valves are merged and connected to the water faucet main unit 2.

By this constitution, when the low-flow electromagnetic valve 14 is released, hot water flowing from the temperature control valve 12 passes through the low-flow electromagnetic valve 14 and flows into the low-flow fixed flow valve 20; here the flow volume is limited to a predetermined small flow volume and discharged from the water faucet main unit 2 spouting port 2*a*. Similarly, when the medium-flow electromagnetic valve 16 is released, hot water passes through the medium-flow electromagnetic valve 16 and flows into the medium-flow fixed flow valve 22; here the flow volume is limited to a predetermined medium-flow volume and discharged from the water faucet main unit 2 spouting port 2*a*; when the large flow electromagnetic valve 18 is released, hot water passes through the large flow electromagnetic valve 18 and flows into the large flow fixed flow valve 24; here the flow volume is limited to a predetermined large flow volume and discharged from the water faucet main unit 2 spouting port 2*a*.

The temperature control valve 12 is constituted to mix and discharge hot water flowing in from the hot water supply pipe 12*a* and cold water flowing in from the cold water supply pipe 12*b*. In the present embodiment, a thermovalve is used as the temperature control valve 12, whereby the temperature is adjusted by driving the main valve body using the biasing force of a shape memory alloy spring and a bias spring. The setting temperature of the hot water discharged from the temperature control valve 12 can be changed by driving a motor 12*c* linked to the temperature control valve 12.

The controller 26 sends signals to each of the temperature control valves 12 based on an electrical signal input from the operating portion 6, thereby controlling the valves. Specifically, the controller 26 comprises an input interface for inputting signals from the operating portion 6; a memory means for storing a control program, set temperature, set flow volume, and the like; a microprocessor to execute programs; an output interface to drive each of the electromagnetic valves and temperature valves (above not shown), and the like. Details of the controller 26 are discussed below.

As shown in FIG. 3, the operating portion 6 has an operating handle 6*a*; an operating portion main unit portion 6*b*; and a rotation detection device 6*c* and pressing detection device 6*d* built into the operating portion main unit portion 6*b*. The operating handle 6*a* is supported by the operating portion main unit portion 6*b* so as to be pushed and rotated by users. The rotation detection device 6*c* is constituted to generate an electrical signal when the operating handle 6*a* is rotated with respect to the operating portion main unit portion 6*b*. A rotational encoder, a potentiometer, or the like are used as the rotation detection device 6*c*. The pressing detection device 6*d* is constituted so that an electrical signal is generated when the operating handle 6*a* is pressed and pushed into the operating portion main unit portion 6*b*. A limit switch, range sensor, pressure sensor, or the like can be used as the pressing detection device 6*d*. In the present embodiment, the operating handle 6*a* is constituted so that when pressed by a user, it is pushed in by a predetermined stroke, and when the pressing force is removed, the operating handle 6*a* is returned to its original position by a biasing spring.

The operating portion may also be constituted so that the operating handle is barely pushed in even when a pressing force is applied by user. In such cases, the pressing operation may be detected by a pressure sensor or the like. Note that in the present Specification, the pressing operation includes both an operation in which the operating handle is pushed in by the pressing force of a user, and the operation in which the operating handle is barely pushed in.

Next, referring to FIGS. 4 through 7, we discuss the operation of the water faucet device 1.

FIG. 4 is a timing chart showing the timing of the operating portion 6 pressing operation on the top row, and spouted water flow volume on the bottom row. FIG. 5 is a flowchart of the control exercised by the controller 26 built into the water faucet functional portion 10. FIG. 6 is a flowchart of the subroutines called in the FIG. 5 flowchart, primarily showing flow adjustment processing. FIG. 7 is flowchart of the subroutines called in the FIG. 5 flowchart, primarily showing temperature adjustment processing.

First, when the power supply is turned on in step S1, the low-flow electromagnetic valve 14, medium-flow electromagnetic valve 16, and large-flow electromagnetic valve 18 are off, which is to say closed, in step S2. The flow adjustment mode MR is set to 2 (medium-flow volume), the stop water timer TS is reset, and the flow adjustment level flag FR is set to 1 (increase). Next, in step S3, the temperature adjustment timer TK is reset, the rotational angle θ of the operating handle 6*a* is set to 0, and the temperature adjustment mode MT is set to 3 (medium/high temperature).

In step S4, a judgment is made as to whether the operating portion 6 has been pushed. If the operating portion 6 has not been pushed, the system will go through the temperature adjustment subroutine step S15, and step S4 processing will be repeated.

Next, when the operating portion 6 is pressed at time t1 in FIG. 4, processing in the controller 26 moves to step S5 in FIG. 5. In step S5, a judgment is made as to whether water flow is in a stopped state, i.e., whether the three electromagnetic valves are all closed. If water flow is in a stopped state, processing advances to step S6; if any of the three collector magnetic valves is open, the system moves to the flowchart processing shown in FIG. 6 (step S16).

In step S6, a judgment is made as to whether the stop water timer TS serving as a time measurement means is within a predetermined timeout time TS1. The stop water timer is a timer built into the controller 26, and is constituted to accumulate the elapsed time after the previous stop water state. If the time elapsed following the previous stopped water state is within the predetermined timeout time TS1, processing advances to step S7; if the timeout time TS1 has elapsed, processing advances to step S11.

In step S7, a judgment is made of the flow adjustment mode MR set at the time of the previous water stopping. If the setting at the time of the previous water stoppage was to a low-flow volume (MR=1), processing advances to step S8; if it was set to a medium-flow volume (MR=2), it advances to step S9; and if it was set to a high volume (MR=3), it advances to step S10. In step S8 the low-flow electromagnetic valve 14 is released; in step S9 the medium-flow electromagnetic valve 16 is released; and in step S10 the high-flow electromagnetic valve 18 is released. After executing processing to release the electromagnetic valves, the system returns to the step S4 processing, passing through the step S15 processing (the temperature adjustment subroutine).

Thus, if the predetermined timeout time TS1 has not elapsed following the previous stopped water state, water spouting commences at the same flow volume as the previous water spouting. Note that in the present embodiment, the timeout time TS1 is set at 1 minute. Also, in the present embodiment, when the operating portion 6 is pushed in the stopped water state, the signal input to the controller 26 rises as shown at time t1 in FIG. 4; the ON edge of that signal is detected and water spouting is commenced.

On the other hand, if the predetermined timeout time TS1 has elapsed, processing advances to step S11; here the flow adjustment mode MR is set to the default flow volume MR=2 (medium-flow volume); the flow adjustment level flag FR is set to 1 (increase); and the temperature adjustment mode MT is set to the default temperature MT=3 (medium/high temperature). In other words, after the timeout time TS1 has elapsed, water spouting is commenced at the default flow volume and default temperature, regardless of the previous water spouting set flow volume and set temperature. As described below, when the flow adjustment level flag FR is set to 1, the flow volume will increase when the operating portion 6 is next pressed for a long period. Furthermore, in step S12 the stop water timer TS is stopped and in step S13 the stop water timer TS is reset to 0. Next, in step S14 the medium-flow electromagnetic valve 16 is released, and the system returns to step S4, passing through the step S15 processing (temperature adjustment subroutine).

After any of the electromagnetic valves is released in steps S8, S9, S10, or S14, the processing of steps S4 and S15 is repeated until the next pressing of the operating portion 6, such that the water spouting state is maintained.

Next, at time t2 in FIG. 4, processing advances to step S5 when the operating portion 6 is again pressed. In the water spouting state, once the step S5 processing is executed, processing advances to step S16, which is the subroutine for processing within the water spouting state. In the FIG. 6 flowchart, as explained below, water spouting is stopped when there is no normal pressing on the operating portion 6, and processing is implemented to change the spouted water volume when the operating portion 6 is pressed for a long time.

In step S10 In FIG. 6, the values of the push timer TP and flow adjustment timer TR built into the controller 26 are set to 0. The push timer TP is the timer which accumulates the elapsed time following a detection of an ON edge at time t2 in FIG. 4. Next, at step S102, accumulation by the push timer TP begins.

Next, in step S103, a judgment is made as to whether the operating portion 6 is being pressed. After a user begins pressing the operating portion 6 at time t2, processing advances to step S109 if the user continues to press the operating portion 6, and processing continues to step S104 if the user stops pressing.

In step S109, a judgment is made as to whether a predetermined long-press determination time TP1 has elapsed in the push timer cumulative time TP. If the predetermined long-press determination time TP1 has elapsed, processing advances to step S110; if it has not elapsed, the system returns to step S103. In the present embodiment, the long-press determination time TP1 is 1 second. As a result of the processing in steps S103 and S109, if 1 or more seconds of pressing the operating portion 6 have elapsed after a user begins pressing the operating portion 6, the processing in steps 110 and below is executed; when pressing of the operating portion 6 is completed, the processing in steps 104 and below are executed.

At time t3 in FIG. 4, when pressing the operating portion 6 ceases, the processing moves to step S104. At step S104, accumulation by the push timer TP is stopped. Furthermore, at step S105, accumulation by the flow adjustment timer TR is stopped.

In step S106, a judgment is made as to whether the push timer cumulative time TP is less than the long-press determination time TP1 (1 second). If the cumulative value TP is less than 1 second—in other words if the interval between times t2 and t3 is less than 1 second—processing advances to step S107; if the cumulative value TP is 1 second or greater, processing in the flowchart shown in FIG. 6 ends, and processing returns to the FIG. 5 flowchart. In step S107, the low-flow electromagnetic valve 14, medium-flow electromagnetic valve 16, and large-flow electromagnetic valve 18 are closed; next, in step S108, accumulation by the stop water timer TS to accumulate the elapsed time following water stoppage is commenced.

Thus, when the operating portion 6 pressing time is less than the 1 second long-press determination time TP1, a judgment is made that the operating portion 6 has been pushed normally, and the stop water processing of step S107 and below is executed. If the pressing operation ends after the operating portion 6 is pressed for 1 second or more, a judgment is made that the long push of the operating portion 6 has ended, and the FIG. 6 flowchart processing is terminated without performing stop water processing.

If, on the other hand, a judgment is made that the cumulative value TP of the push timer is 1 second or greater, processing advances to step S110. In step S110, a judgment is made as to whether the flow adjustment timer TR value is 0; if the flow adjustment timer TR value is 0, processing advances to step S111 and accumulation by the flow adjustment timer TR begins. If the value of flow adjustment timer TR is not 0 in step S110, processing advances as is to step S112.

The flow adjustment timer TR accumulates elapsed time following a judgment that the operating portion 6 has been long-pressed. That is, accumulation in the push timer TP is started when the operating portion 6 is pushed at time t4 in FIG. 4; accumulation in the flow adjustment timer TR begins when the push timer TP reaches 1 second at time t5.

Next, in step S112, a judgment is made as to whether the flow adjustment timer TR cumulative value has passed the predetermined flow adjustment time TR1. In the present embodiment, the predetermined flow adjustment time TR1 is set at 0.5 seconds. If 0.5 seconds has not elapsed since the start of accumulation by the flow adjustment timer TR (time t5), processing returns to step S103; if 0.5 seconds has elapsed, processing returns to step S113. If pressing on the operating portion 6 has continued after time t5, the processing in steps S103, S109, S110, and S112 is repeated.

If pressing continues, processing moves to step S113 at time t6 when the flow adjustment timer cumulative value TR reaches 0.5 seconds. In step S113, the flow adjustment mode MR value is judged. When the flow adjustment mode MR=1 (low-flow volume), processing advances to step S114; when the flow adjustment mode MR=2 (medium-flow volume), it advances to step S117; when the flow adjustment mode MR=3 (large flow volume), it advances to step S122.

In step S113, if the value of the flow adjustment mode MR is set to 2, processing advances to step S117; in step S117, the value of the flow adjustment level flag FR is judged. When the flow adjustment level flag FR=1 (increase flow), processing advances to step S118; when the flow adjustment level flag FR=−1 (decrease flow), processing advances to step S120. In the processing to increase flow adjustment, the large flow volume electromagnetic valve 18 is released in step S118, and the medium-flow volume electromagnetic valve 16 is closed in step S119. On the other hand, in the processing to decrease flow adjustment, the small flow volume electromagnetic valve 14 is released in step S120, and the medium-flow volume electromagnetic valve 16 is closed in step S121.

In step S113, if the flow adjustment mode MR value is set at 1 (small flow volume), processing advances to step S114, and processing to increase flow is performed. In other words, in step S114 the medium-flow volume electromagnetic valve 16 is released; in step S115 the small flow volume electromagnetic valve 14 is closed; and in step S116, the flow adjustment level flag FR is set to 1.

Furthermore, in step S113, if the value of the flow adjustment mode MR is set to 3 (large flow volume), processing advances to step S112, and processing to decrease flow volume is executed. In other words, in step S122 the medium-flow volume electromagnetic valve 16 is released; in step S123 the large flow volume electromagnetic valve 18 is closed; and in step S124, the flow adjustment level flag FR is set to −1.

After processing to increase or decrease flow volume is completed, at step S125 the value of the flow adjustment level flag FR is added to the value of the flow adjustment mode MR and the value of the flow adjustment mode MR is updated. Next, in step S126, the flow adjustment timer TR value is reset to 0.

In the example shown in FIG. 4, a setting to a flow adjustment mode MR=2 is made at time t6; since the flow adjustment level flag FR is set at 1, the processing of steps S117, S118, and S119 is performed following step S113, and the flow volume is changed from a medium-flow volume to a large-flow volume. Following this, the flow adjustment mode MR is changed to 3 in step S125; in step S126 the flow adjustment timer TR is reset, and processing returns to step S103.

Following this, if pressing of the operating portion 6 continues, processing advances to steps S103, S109, S110, and S111 (flow adjustment timer TR starts), then returns to step S103. If pressing of the operating portion 6 continues, processing advances to steps S109, S110, S112, returning to step S103, whereupon this processing is repeated.

When 0.5 seconds have elapsed from time t6 with the operating portion 6 continuing to be pressed, time t7 is reached, whereupon processing advances from step S122 to steps S113, S122, S123, and S124; flow volume is changed from a large flow volume to a medium-flow volume, and processing returns to step S103. Furthermore, when 0.5 seconds have elapsed from time t7 with the operating portion 6 continuing to be pressed, time t8 is reached, whereupon processing advances from step S112 to steps S113, S117, S120, and S121; flow volume is changed from a large flow volume to a medium-flow volume, and processing returns to step S103. Thus, in the water faucet device of the present embodiment, flow volume is changed in a three stage stepwise fashion; when pressing continues, the spouted water flow volume repeatedly increases or decreases in a stepped fashion.

After returning to step S103, processing advances to steps S109, S110, and S112; if pressing of the operating portion 6 ends at time t9 during the period that the processing to return to step S103 is being repeated, processing advances from step S103 to step S104, following which the processing of steps S104, S105, and S106 are implemented and the flowchart processing shown in FIG. 6 ends (returns to the FIG. 5 flowchart processing).

If, after returning to the FIG. 5 flowchart processing, the operating portion 6 is pressed at time t10, processing passes through step S5 in FIG. 5, and advances to the flowchart shown in FIG. 6. Moreover, if pressing ends at time t11 when less than 1 second has elapsed from time t10, processing advances to steps S103, S104, S105, S106, S107, and S108 shown in FIG. 6, and processing to stop water flow is implemented. Thus in the present embodiment, when the operating portion 6 is pressed in the spouting state, the signal input to the controller 26 falls as shown at time t11 in FIG. 4; the OFF edge of that signal is detected and water spouting is stopped.

Next, referring to FIG. 7, we discuss temperature adjustment processing in the controller 26.

The flowchart shown in FIG. 7 indicates the subroutine called at step S15 in the FIG. 5 flowchart. First, at step S201 in FIG. 7, the rotational angle θ of the operating handle 6*a* is read from the operating portion 6 rotation detection device 6*c*. This rotational angle θ does not indicate the absolute rotational position of the operating handle 6*a*, but rather the rotational angle when the controller 26 is set to θ=0. The operating handle 6*a* is constituted so that the operating handle 6*a* may be rotated left or right without limitation. In the initial state of the water faucet device 1, the rotational angle θ is set to 0 at step S3 in FIG. 5, immediately after the power supply is turned on. In other words, while the rotational position of the operating handle 6*a* is set at a rotational angle θ=0 when the power supply is turned on, this rotational angle θ=0 is changed while the water faucet device 1 is in use.

Next, at step S202, a judgment is made as to whether the rotational angle value is 0. That is, a judgment is made as to whether the operating portion 6 has been rotated from the recently set rotational angle θ=0 position. If the rotational angle θ=0, no rotary operation has been effected, therefore the flowchart processing shown in FIG. 7 is ended, and processing returns to the FIG. 5 flowchart.

If the rotational angle θ is not 0, processing advances to step S203, and a judgment is made as to whether the value of the rotational angular velocity (dθ/dt) of the operating handle 6*a* is 0 or not. If the rotational angular velocity (dθ/dt) is 0, processing advances to step S204; if it is not 0, processing advances to step S209. That is, if the rotational angle θ is not 0, and the rotational angular velocity (dθ/dt) is also not 0, and it is judged that that the rotary operation is continuing, processing advances to temperature adjustment processing in step S209 and below. At S204 and below, processing is implement for the case in which rotary operation was being implemented, but was ended (rotational angular velocity is 0).

At step S209, a judgment is made as to whether the absolute value of the rotational angle θ is at or above a predetermined rotary operation determining angle θA. In other words, if the rotational angle θ is less than the rotary operation determining angle θA, processing will return to the FIG. 5 flowchart without changing the temperature setting. In the present embodiment, the rotary operation determining angle θA is set at 40°. During the period following initiation of rotary operation by a user, while the absolute value of the rotational angle θ starting from the initiation of the rotary operation is less than the rotary operation determining angle θA, the processing in the FIG. 7 steps S201, S202, S203, S209, FIG. 5 steps S4, S15, and FIG. 7 step S201 is repeated.

If the absolute value of the rotational angle θ reaches the rotary operation determining angle θA while these processes are being repeated, processing moves to step S210 in FIG. 7. At step S210, a splitting destination is determined based on the value of the current temperature adjustment mode MT. When the temperature adjustment mode MT=1 (low temperature), processing advances to step S211; when temperature adjustment mode MT=2 (medium low temperature), to step S213; when temperature adjustment mode MT=3 (medium high temperature), to step S219; and when temperature adjustment mode MT=4 (high temperature), to step S224.

At step S211, where the current temperature adjustment mode MT is 1 (low temperature), the polarity of the rotational angle θ is determined. When the rotational angle θ is positive (right rotation), processing advances to step S212; when the rotational angle θ is negative (left rotation), processing advances to step S227 without changing the temperature setting. In other words, when the temperature adjustment mode MT is 1 (low temperature), the set temperature rises if there is a right rotating rotary operation, but left rotating rotary operations are ignored.

At step S212, the controller 26 sends a signal to the motor 12*c*, and the set temperature of the temperature control valve 12 is caused to rise to a medium low temperature. In addition, the value of the temperature adjustment mode MT is updated at step S213, and changed to MT=2 (medium low temperature). Next, advancing to step S227, the origin of the rotational angle θ is updated. That is, the rotational position of the operating handle 6*a* at the time when step S227 is executed following the end of processing to change the setting temperature, is newly set at a rotational position of rotational angle θ=0. Therefore in order to further raise the setting temperature by another step and change to a medium-high temperature, the operating handle 6*a* must be further rotated to the right by 40° from the rotational position at which the rotational angle θ had been newly set to 0. At step S227, the temperature adjustment timer TK is stopped, and its cumulative value is reset to 0.

On the other hand, if the current temperature adjustment mode MT was 2 (medium low temperature) at step S210, processing advances to step S214. At step S214, the polarity of the rotational angle θ is determined; if the rotational angle θ is positive (right rotation), processing advances to step S215; if the rotation angle θ is negative (left rotation), processing advances to step S217. At steps S214 and S216, the setting temperature of the temperature adjustment valve 12 is raised to the medium high temperature, and the value of the temperature adjustment mode MT is updated and changed to MT=3 (medium-high temperature). At step S217 and S218, conversely, the setting temperature of the temperature adjustment valve 12 is lowered to the low temperature, and the value of the temperature adjustment mode MT is updated and changed to MT=3 (low temperature).

Similarly, in the processing in step S219, a right rotary operation of the operating handle 6*a* raises the setting temperature to the high temperature, and a left rotary operation reduces the setting temperature to a low temperature. In the processing in step S224 and below, a right rotation of the operating handle 6*a* is ignored, and a left rotation reduces the setting temperature to a medium-high temperature.

We next discuss the processing in steps S204 and below in FIG. 7. The processing of steps S204 and below are executed when the rotary operation ends (dθ/dt=0) after the operating handle 6*a* has been rotated. First, at step S204, a judgment is made as to whether the value of the temperature adjustment timer TK is 0. The temperature adjustment timer TK is a timer which accumulates elapsed time after a rotary operation has occurred and that rotary operation has ended. When the value of the temperature adjustment timer TK is 0, processing advances to step S205, where accumulation by the temperature adjustment timer TK begins. When the value of the temperature adjustment timer TK is not 0, processing advances to step S206 without executing step S205.

At step S206, a judgment is made as to whether the value of the temperature adjustment timer TK has reached a predetermined origin update time TKlimit. If the value of the temperature adjustment timer TK has reached the predetermined origin update time TKlimit, processing advances to step S207; if it has not reached TKlimit, processing advances to step S209. In the present embodiment, the origin update time TKlimit is set to 2 seconds. If the absolute value of the rotational angle θ is 40° or greater when the rotary operation ends (dθ/dt=0), processing to change the temperature setting is implemented in step S210 and below, following which in step S227 the value of the rotational angle θ is returned to 0.

On the other hand, if the rotational angle when the rotary operation ends is less than 40°, processing is carried out in the order of steps S206, S209, FIG. 5 steps S4, S15, FIG. 7 steps S201, S202, S203, S204, and S206 before the origin update time TKLimit elapses, and this processing is repeated.

When the origin update time TKLimit elapses during the repetition of this processing, processing advances to step S207. At step S207, the temperature adjustment timer TK is stopped, and its cumulative value is reset to 0. Next, at step S208, the rotational angle θ is returned to 0, and processing returns to the FIG. 5 flowchart. Thus, after a rotary operation has been conducted and that operation has ended, once the 2 second origin update time TKLimit has elapsed, the value of the rotational angle θ is returned to 0, therefore subsequent updating of the setting temperature requires that the operating handle 6*a* be newly rotated by 40° or more. Conversely if, after implementing a rotary operation, that operation is temporarily halted and rotary operation is restarted in less than 2 seconds, the rotational angle before and after halting the operation is accumulated, and the setting temperature is changed when that the total rotational angle reaches 40° or greater.

Thus in the water faucet device 1 of the present embodiment, the rotational angle θ is set to 0, and the spouted water temperature is changed in response to the rotational angle of a single rotary operation, which is the rotary operation during the period until the next update of the rotational angle θ origin. When the rotational angle of the operating portion in a single rotary operation is less than the rotary operation determining angle θA, that operation is ignored, and no change is made in the spouting water temperature.

In the water faucet device of the first embodiment of the present invention, switching between starting and stopping of spouting, and adjustment of flow volume, can be accomplished by pressing the operating portion, and adjustment of the spouted water temperature can be accomplished by rotating the operating portion, therefore switching between starting and stopping of spouting, adjustment of flow volume, and adjustment of spouted water temperature can all be accomplished by a single operating portion.

In the water faucet device of the present embodiment, the spouted water temperature is changed in response to the rotational angle of the operating portion in a single rotary operation, therefore the spouted water temperature is changed not by the absolute rotational position but rather by the relative rotational position of the operating portion. Ease of the temperature adjustment operation can thus be improved.

Furthermore, in the water faucet device of the present embodiment, the spouted water temperature is not changed when the rotary operation angle in a single rotary operation is less than the rotary operation determining angle, therefore accidental rotation of the operating portion during a pressing operation causing an unintended change in the spouted water temperature can be prevented.

Also, in the water faucet device of the present embodiment, spouting is started at the previously set flow volume and set temperature, therefore resetting is unnecessary, and operability of the water faucet device can thus be improved.

Moreover, in the water faucet device of the present embodiment, the previously set flow volume and set temperature are returned to the default flow volume and default temperature when a predetermined time has elapsed following the end of spouting, therefore unanticipated startup of spouting at an unexpected flow volume or the like due to the previous user's settings can be avoided when it is presumed that the water faucet user has changed.

Also, in the water faucet device of the present embodiment, step-wise increasing and decreasing of the spouted water volume is repeated by continuously pressing on the operating portion, therefore the spouted water flow volume can be increased or decreased in a single operation.

Note that the explanation of the operation of the present first embodiment used an example in which the operating handle 6*a* was pushed for a predetermined long-press determining time or greater from time t4 to time t9 in FIG. 4 in the spouting state, but an operation to change the spouted water flow volume can similarly be carried out after the first spouting begins, even if the operating handle 6*a* is pushed for a predetermined long-press determining time or greater in the stop water state.

Next, referring to FIGS. 8 through 12, we discuss the water faucet device of a second embodiment of the present invention. With respect to the point that flow volume adjustment is performed using the amount of pressing force pressing on the operating portion, the water faucet device of the present embodiment differs from the above-described first embodiment. Therefore we shall here discuss only those points about the present embodiment which differ from the first embodiment, and omit a discussion of similar points.

Figure 8:
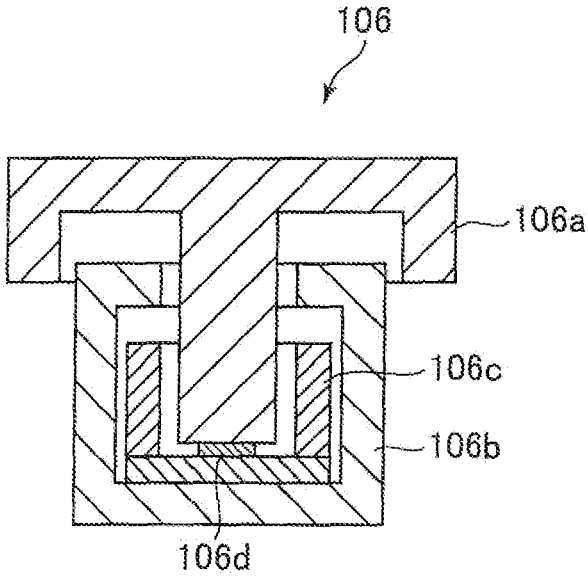
Figure 9:
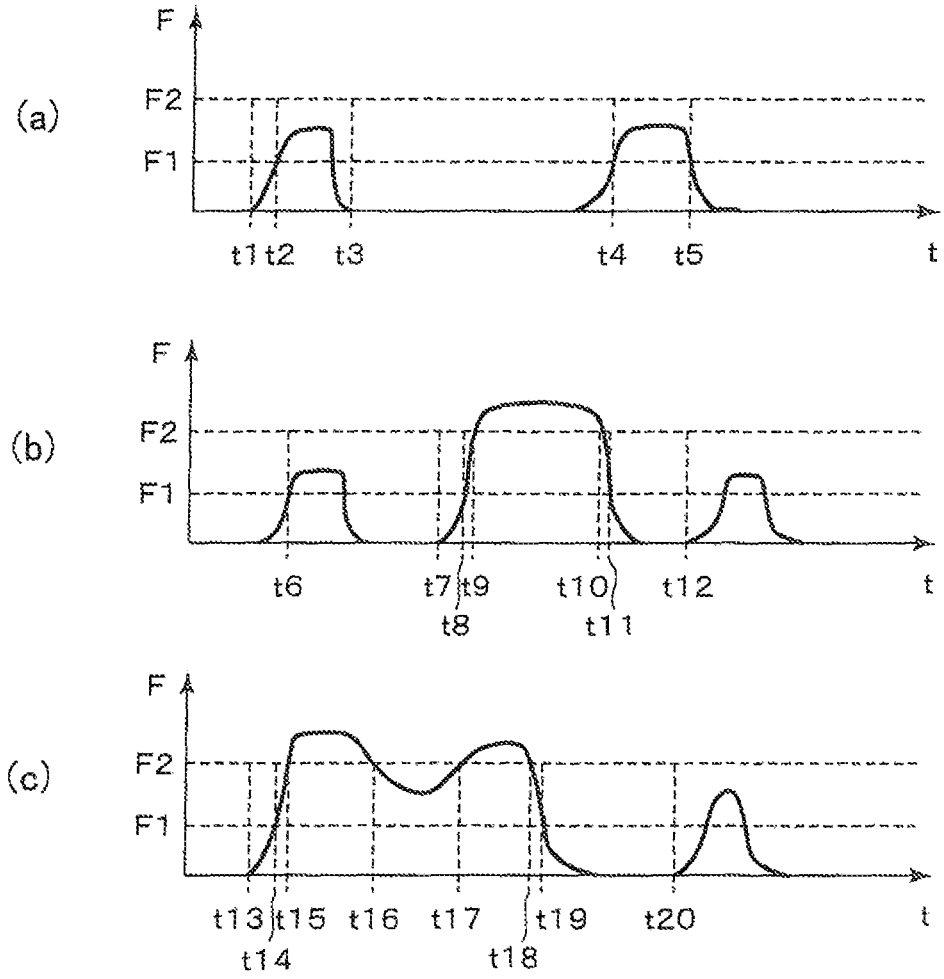
Figure 12:
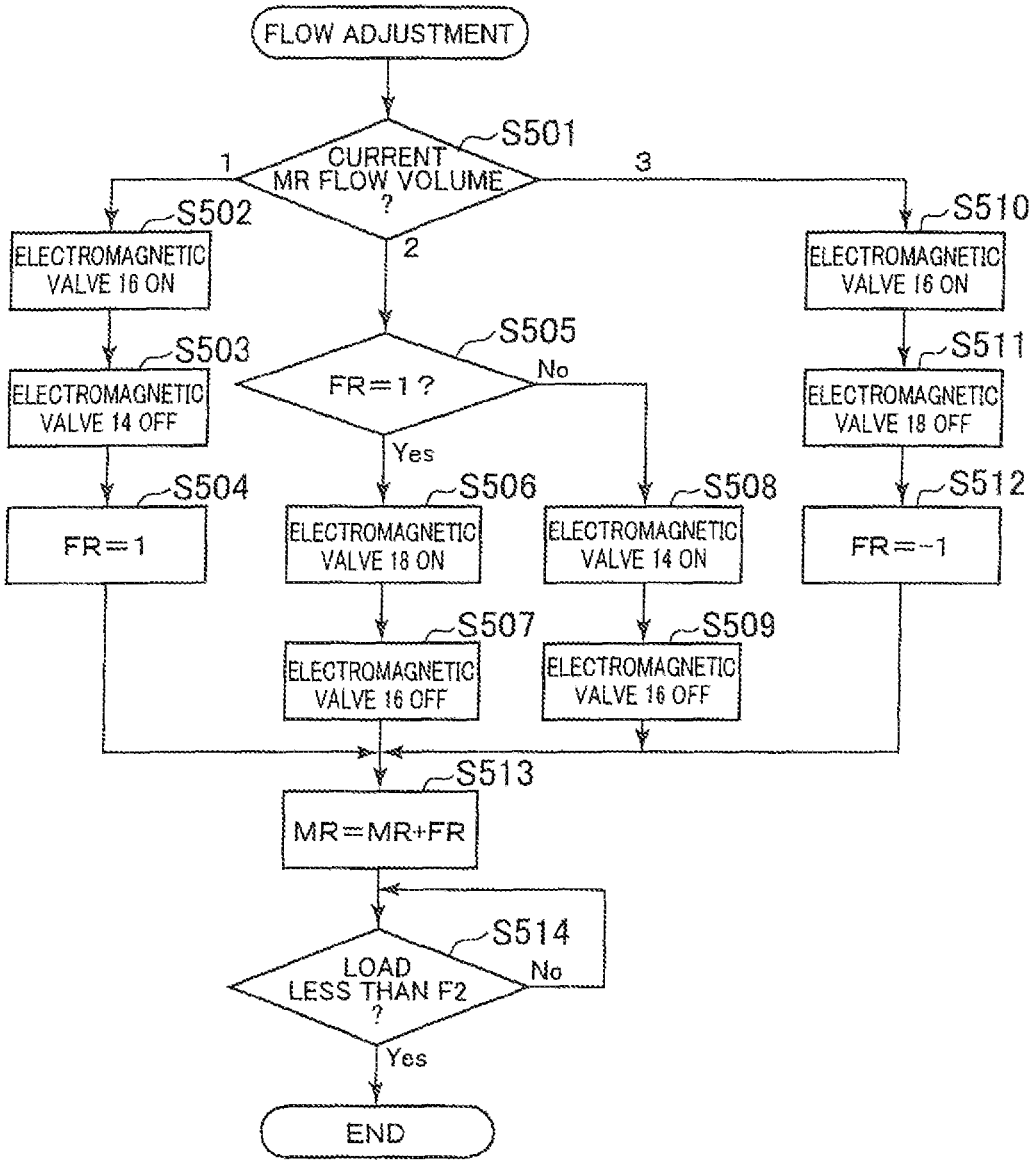

FIG. 8 is a cross-section of the operating portion used in a water faucet device according to a second embodiment of the invention. FIG. 9 is a timing chart showing the operation of a water faucet according to the present embodiment. In addition, FIGS. 10 through 12 are flowcharts of the control in the water faucet of the present embodiment As shown in FIG. 8, the operating portion 106 used in the water faucet device of the second embodiment of the present invention has an operating handle 106*a*, an operating portion main unit portion 106*b*, a rotation detection device 106*c* built into the operating portion main unit portion 106*b*, and a pressing detection device 106*d*. In the present embodiment, the pressing detection device 106*d* comprises a pressure sensor; an electrical signal is generated in response to the pressing force pressing on the operating handle 106*a*, and this signal is sent to the controller 26. Also, in the present embodiment the operating handle 106*a* is barely pushed in at all by the pressing operation; the stroke of the operating handle 106*a* is essentially 0.

Next, referring to FIGS. 9 through 12, we discuss the operation of the water faucet device of a second embodiment.

FIG. 10 is a flowchart of the control implemented by the controller 26 built into the water faucet functional portion 10. FIG. 11 is a flowchart of the subroutine called by the FIG. 10 flowchart, and FIG. 12 is a flowchart of the subroutine called by the FIG. 11 flowchart.

The flowchart shown in FIG. 10 is the same as the flowchart shown in FIG. 5 except for the setting of the flow adjustment flag FK to 0 in step S302, and the processing in step S304. In step S304, a judgment is made as to whether the pressing force on the operating portion 106 detected by the pressing detection device 106*d* exceeds a predetermined first operating force F1.

First, pressing of the operating handle 106*a* starts at time t1 in FIG. 9(*a*); if this exceeds the first operating force F1 at time t2, processing moves from step S304 to step S305. At step S305, a judgment is made as to whether the device is in the spouting state; if in the stopped spouting state, the processing in steps S306 through S314 or steps as 306 through S310 is executed, and the device goes into a spouting state. Next, processing advances to step S315, and a temperature adjustment subroutine is called, but since processing in this subroutine is the same as that in the flowchart shown in FIG. 7, a discussion thereof is here omitted.

Next, the pressing operation ends at time t3 in FIG. 9, but in this embodiment the time during which the pressing operation continues does not affect the operation of the water faucet device. Next, if the pressing operation is again implemented and the first operating force F1 is exceeded at time t4, processing moves from step S304 in FIG. 10 to step S305, and processing moves from step S305 to step S316. At step S316, the subroutine shown in FIG. 11 is called.

At step S401, a judgment is made as to whether the pressing force on the operating portion 106 detected by the pressing detection device 106*d* exceeds a second operating force F2, which is a predetermined flow adjustment starting pressing force. When, as shown in FIG. 9(*a*), the pressing force is smaller than the second operating force F2, processing advances to step S402. At step S402, a judgment is made as to whether the pressing force is smaller than the predetermined first operating force F1. If the pressing force is greater than the first operating force F1, processing returns to step S401; if smaller than the first operating force F1, processing returns to step S403. If, as is the case between time t4 and t5 in FIG. 9(*a*), the pressing force is greater than the first operating force F1 and smaller than the second operating force F2, the processing of steps S401 and S402 is repeated.

Next, if the pressing force at time t5 falls below the first operating force F1, processing moves from step S402 to step S403. At step S403, the flow adjustment flag FK value is judged. If the flow adjustment flag. FK=0 (no flow adjustment has been implemented), processing advances to step S404; if the flow adjustment flag FK=1 (flow adjustment has been implemented), processing advances to step S407.

When the flow adjustment flag FK=0, a judgment is made that the very recent pressing operation was a stop water operation, therefore each electromagnetic valve is placed in a stop spouting state in steps S404 through S406; the flow adjustment flag FK is set to 0, and accumulation by the stop water timer TS begins; the processing in the FIG. 11 flowchart ends, and processing returns to the FIG. 10 flowchart. On the other hand, when the flow adjustment flag FK=1, a judgment is made that the recent pressing operation was a flow adjustment operation, therefore the flow adjustment flag FK is set to 0 in step S407, the processing in the FIG. 1 flowchart is ended without performing stop water processing, and processing returns to the FIG. 10 flowchart.

Next, in the example shown in FIG. 9(*b*), spouting begins at time t6. Furthermore, if the pressing operation is again begun at time t7, and the pressing force exceeds the first operating force F1 at time t8, processing moves from the FIG. 10 steps S304, S305, and S316 to the FIG. 11 step S401. During the period between times t8 and t9 when the pressing force is greater than the first operating force F1 and smaller than the second operating force F2, the processing in steps S401 and S402 is repeated.

If the pressing force at time t9 exceeds the second operating force F2, processing moves from step S401 to step S408. At step S408, the subroutine shown in FIG. 12 is called.

In the FIG. 12 step S501, the flow adjustment mode MR value is judged. If the value of the flow adjustment mode MR is 1 (low-flow volume), the processing in steps S502 and below is executed. In other words, in steps S501 through S503, the flow volume is increased to a medium-flow volume, the flow adjustment level flag is set to FR=1 (increase flow volume), and processing is advanced to step S513. If the value of the flow adjustment mode MR is 2 (medium-flow volume), the processing in steps S505 and below is executed. In other words, if the flow adjustment level flag FR=1, flow volume is increased to the large flow volume; if the flow adjustment level flag FR=−1, flow volume is decreased to the small flow volume, and processing advances to step S513. If the value of the flow adjustment mode MR is 3 (large flow volume), the processing in steps S510 and below is executed. In other words, in steps S510 through S512, the flow volume is decreased to a medium-flow volume, the flow adjustment level flag is set to FR=−1 (decrease flow volume), and processing is advanced to step S513.

Next, in step S513, the value of the flow adjustment level flag FR is added to the value of the flow adjustment mode MR and the value of the flow adjustment mode MR is updated. Furthermore, at step S514, a judgment is made as to whether the pressing force has fallen below the second operating force F2; if the pressing force has not fallen below the second operating force F2, the processing in step S514 is repeated; if the pressing force has fallen below the second operating force F2, processing returns to the FIG. 11 flowchart. That is, the step S514 processing is repeated after the pressing force exceeds the second operating force F2 and flow adjustment processing has been performed, until the pressing force falls below the second operating force F2 at time t10. If the pressing force at time t10 falls below the second operating force F2, processing returns to step S408 in the FIG. 11 flowchart.

When processing returns from the FIG. 12 flowchart to the FIG. 11 flowchart, step S409 processing is executed, and the flow adjustment flag FK value is set to 1. Next, at time t11, the step S401 and S402 processing is repeated until the pressing force falls below the first operating force F1.

When the pressing force falls below the first operating force F1 at time t11, processing advances to step S403; here a judgment is made as to whether the value of the flow adjustment flag FK is 0. The value of the flow adjustment flag FK is set to 1 in step S409, so processing advances to step S407, and the value of the flow adjustment flag FK is returned to 0. Finally, if a pressing operation is performed at time t12, water is stopped, in the same way as it is with the second pressing operation shown in FIG. 9(*a*).

Next, in the example shown in FIG. 9(*c*), the pressing operation is begun at time t13; if the pressing force exceeds the first operating force F1 at time t14, processing moves from the FIG. 10 steps S304 and S305 to step S306. At step S306 and below, spouting is started by the processing of steps S307 and below or steps S311 and below.

After the pressing force exceeds the first operating force F1 at time t14, processing advances to steps S304, S305, and S316, and the FIG. 11 subroutine processing is started. Following time t14, processing in steps S401 and S402 is repeated until the pressing force exceeds the second operating force F2 at time t15. When the pressing force exceeds the second operating force F2 at time t15, processing advances to step S408, the subroutine in FIG. 12 is called, and flow adjustment processing is implemented.

After flow adjustment processing by the FIG. 12 subroutine, the FIG. 12 step S514 is repeated until the pressing force falls below the second operating force F2 at time t16. When the pressing force falls below the second operating force F2 at time t16, processing returns to the FIG. 11 subroutine, and the flow adjustment flag FK is set to 1 at step S409. Next, following time t16, processing in steps S401 and S402 is repeated until the pressing force exceeds the second operating force F2 at time t17.

When the pressing force again exceeds the second operating force F2 at time t17, processing advances to step S408, the subroutine in FIG. 12 is called, and flow adjustment processing is implemented. Next, if the pressing force at time t18 falls below the second operating force F2, processing returns to the subroutine in the FIG. 11 flowchart. Furthermore, if the pressing force falls below the first operating force F1 at time t19, processing advances to steps S402, S403, and S407, and returns to the FIG. 10 flowchart. Finally, water is stopped by the pressing operation which starts at time t20.

In the water faucet device of the second embodiment of the present invention, switching between starting and stopping of spouting, and adjustment of flow volume, can be accomplished by pressing the operating portion, and adjustment of the spouted water temperature can be accomplished by rotating the operating portion, therefore switching between starting and stopping of spouting, adjustment of flow volume, and adjustment of spouted water temperature can all be accomplished by a single operating portion.

Figure 13:
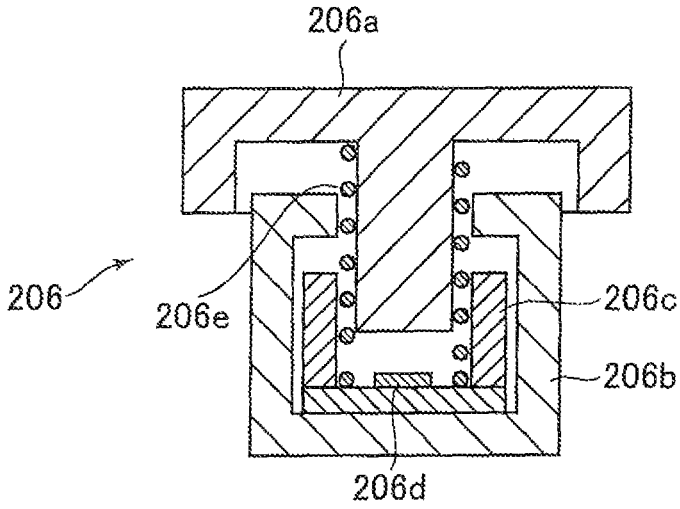

Next, referring to FIG. 13, we discuss the water faucet device of a third embodiment of the present invention. The water faucet device of the present embodiment differs from the above-described second embodiment in that a user's pressing operation is detected using the stroke (distance) by which the operating portion operating handle is pushed in. Therefore we shall here discuss only those points about the third embodiment of the present invention which differ from the second embodiment, and shall omit a discussion of similar points. FIG. 13 is a cross-section of the operating portion used in a water faucet device according to a third embodiment of the invention.

As shown in FIG. 13, the operating portion 206 used in the water faucet device of the third embodiment of the present invention has an operating handle 206*a*, an operating portion main unit portion 206*b*, a rotation detection device 206*c* built into the operating portion main unit portion 206*b*, and a pressing detection device 206*d*. In the present embodiment, the pressing detection device 206*d* comprises a distance sensor; an electrical signal is generated in response to the stroke by which the operating handle 206*a* is pushed in, and this signal is sent to the controller 26. Also, in the present embodiment the pushed-in operating handle 206*a* is biased by a biasing spring 206*e*, and the operating handle 206*a* is pushed back to its original position when a user's pressing force ceases to act upon it.

Processing in the controller 26 of the third embodiment of the present invention corresponds to replacing the "pressing force" in the second embodiment flowchart with "push-in stroke." Specifically, the processing in the FIG. 10 step S304 is changed to a judgment of whether the push-in stroke exceeds a first push-in stroke L1; the processing in the FIG. 11 step S401 is changed to a judgment of whether the push-in stroke exceeds a second push-in stroke L2, being a predetermined flow adjustment start stroke; the processing of step S402 is changed to a judgment of whether the push-in stroke has fallen below the first push-in stroke L1; and the processing in step S514 of FIG. 12 is changed to a judgment of whether the push-in stroke has fallen below the second push-in stroke L2. With the exception of those points, the operation of the water faucet device of the present embodiment is the same as that of the second embodiment, and we therefore omit a discussion thereof.

In the water faucet device of the third embodiment of the present invention, switching between starting and stopping of spouting, and adjustment of flow volume, can be accomplished by pushing in the operating portion, and adjustment of the spouted water temperature can be accomplished by rotating the operating portion, therefore switching between starting and stopping of spouting, adjustment of flow volume, and adjustment of spouted water temperature can all be accomplished by a single operating portion.

EXPLANATION OF REFERENCE NUMERALS

FR flow adjustment level flag
FK flow adjustment flag
MR flow adjustment mode
MT temperature adjustment mode
TS stop water timer
TP push timer
TR flow adjustment timer
TK temperature adjustment timer
θ rotational angle
1 water faucet device according to the first embodiment of the present invention
2 water faucet main unit
2*a* spouting port
4 wash bowl
6 operating portion
6*a* operating handle
6*b* operating portion main unit portion
6*c* rotation detection device
6*d* pressing detection device
8 sink counter
10 water faucet functional portion (flow volume/temperature adjustment means)
12 temperature control valve
12*a* hot water supply pipe
12*b* cold water supply pipe
14 low-flow electromagnetic valve
16 medium-flow electromagnetic valve
18 large-flow electromagnetic valve
20 low-flow fixed flow valve
22 medium-flow fixed flow valve
24 large flow fixed flow valve
26 controller
106 operating portion
106*a* operating handle
106*b* operating portion main unit portion
106*c* rotation detection device
106*d* pressing detection device
206 operating portion
206*a* operating handle
206*b* operating portion main unit portion
206*c* rotation detection device
206*d* pressing detection device
206*e* biasing spring

The invention claimed is:

1. A water faucet device furnished with a flow volume adjustment and a temperature adjustment, comprising:

an operating portion adapted to be pressed and rotated by a user to generate a control signal to control the water faucet device;

at least one flow valve adapted to control flow volume in accordance with a water flow control signal;

a temperature adjustment valve adapted to receive water from a hot water inlet and a cold water inlet and to adjust water temperature in accordance with a temperature control signal;

a microprocessor adapted to receive the control signal from the operating portion and provide the water flow control signal to said at least one flow valve to turn the water flow on or off, and to control flow volume adjustment, and to provide the temperature control signal to the temperature adjustment valve to effect temperature adjustment; and a flow volume/temperature adjustment module adapted to be executed by the microprocessor to the operating portion when the operating portion is pressed to provide a flow of water, change flow volume or stop the flow of water, and when the operating portion is rotated to change water temperature; and wherein, in a stopped water state, the flow volume/temperature adjustment is adapted to cause spouting to start when the operating portion is pressed;

in a spouting state, the flow volume/temperature adjustment is adapted to change spouted water flow volume when the operating portion is pressed continuously for a predetermined long-press determining time; and the flow volume/temperature adjustment is adapted to stop spouting when pressing of the operating portion ceases in less than the long-press determining time.

2. The water faucet device according to claim 1, wherein the operating portion is configured so that there is no limit on the angle by which it can be rotated; and the flow volume/temperature adjustment module is adapted to change the spouting water temperature in response to the rotational angle of the operating portion in a single rotary operation.

3. The water faucet device according to claim 2, wherein the flow volume/temperature adjustment is adapted to adjust the spouted water temperature in a stepped manner in response to the rotary operation angle of the operating portion in a single rotary operation, and to not change the spouted water temperature when the rotary operation angle in a single rotary operation is less than a predetermined rotary operation determining angle.

4. The water faucet device according to claim 1, wherein the flow volume/temperature adjustment module includes a storage memory to store a set flow volume and set temperature just before spouting is stopped such that when next spouting is started, the flow volume/temperature adjustment module is configure to start spouting at the set flow volume and set temperature stored in the storage memory.

5. The water faucet device according to claim 4, wherein the flow volume/temperature adjustment module includes a time counter to accumulate elapsed time following the previous end of spouting; when the elapsed time added up by the time counter is equal to or greater than a predetermined timeout time, the flow volume/temperature adjustment is adapted to cause spouting to start at a predetermined default flow volume and default temperature, regardless of the set volume and set temperature stored in the storage memory.

6. The water faucet device according to claim 1, wherein the flow volume/temperature adjustment is adapted to change the flow volume in a multistage stepped fashion, and to produce a repeated stepped increase and decrease in the spouted water flow volume.

* * * * *